US010670348B2

(12) United States Patent
Lv et al.

(10) Patent No.: US 10,670,348 B2
(45) Date of Patent: Jun. 2, 2020

(54) HEAT EXCHANGER

(71) Applicant: Zhejiang Sanhua Automotive Components Co., Ltd., Hangzhou, Zhejiang (CN)

(72) Inventors: Zhou Lv, Hangzhou (CN); Jiang Zou, Zhejiang (CN); Fangfang Yin, Zhejiang (CN); Kai Cui, Hangzhou (CN); Linjie Huang, Hangzhou (CN)

(73) Assignee: Zhejiang Sanhua Automotive Components Co., Ltd., Hangzhou, Zhejiang (CN)

( * ) Notice: Subject to any disclaimer, the term of this patent is extended or adjusted under 35 U.S.C. 154(b) by 177 days.

(21) Appl. No.: 15/898,540

(22) Filed: Feb. 17, 2018

(65) Prior Publication Data

US 2018/0172357 A1 Jun. 21, 2018

Related U.S. Application Data

(62) Division of application No. 14/835,237, filed on Aug. 25, 2015, now abandoned.

(30) Foreign Application Priority Data

Aug. 27, 2014 (CN) ..... 2014 1 0428901
Jul. 9, 2015 (CN) ..... 2015 1 0405114
(Continued)

(51) Int. Cl.
*F28D 9/00* (2006.01)
*F28F 9/02* (2006.01)

(52) U.S. Cl.
CPC ..... *F28D 9/0093* (2013.01); *F28D 9/005* (2013.01); *F28F 9/026* (2013.01); *F28F 9/0273* (2013.01)

(58) Field of Classification Search
CPC ..... F28D 9/00; F28D 9/005; F28D 9/0093; F28D 9/02; F28F 9/00; F28F 9/02; F28F 9/026; F28F 9/0273
(Continued)

(56) References Cited

U.S. PATENT DOCUMENTS 5,479,784 A 1/1996 Dobmeier et al.
7,845,397 B2 * 12/2010 Bellemo ..... B01D 5/0015 165/111
(Continued)

FOREIGN PATENT DOCUMENTS

CN 1985142 A 6/2007
CN 102818475 A 12/2012
(Continued)

OTHER PUBLICATIONS

Chinese 1st Office Action dated Jul. 6, 2018 in connection with Chinese Application No. 201410428901.0.
(Continued)

*Primary Examiner* — Keith M Raymond
*Assistant Examiner* — Gustavo A Hincapie Serna
(74) *Attorney, Agent, or Firm* — Wolf, Greenfield & Sacks, P.C.

(57) ABSTRACT

A plate heat exchanger is provided in the present application, which includes multiple first plates and multiple second plates which are alternately stacked together, first flow passages and second flow passages spaced from each other are formed between the first plates and the second plates, a first passage is formed by first orifices, a second passage is formed by second orifices, and the first passage and the second passage are in communication with each other via the first flow passages or the second flow passages to form a first fluid passage. At least one damping structure is provided in the first fluid passage, and at least a part of the
(Continued)

first fluid passage is in communication with a first pipe or a second pipe via the damping structure.

4 Claims, 9 Drawing Sheets

(30) Foreign Application Priority Data

Jul. 9, 2015 (CN) ..... 2015 2 0499659 U
Jul. 9, 2015 (CN) ..... 2015 2 0500338 U

(58) Field of Classification Search
USPC ..... 165/140, 166, 167, 178, 76
See application file for complete search history.

(56) References Cited

U.S. PATENT DOCUMENTS 8,596,343 B2 * 12/2013 Christensen ..... F28D 9/005 165/165
9,093,729 B2 * 7/2015 Wesner ..... B60H 1/00
9,121,643 B2 * 9/2015 Schaefer ..... F25B 39/022
9,618,280 B2 * 4/2017 Magnier-Cathenod ..... F28D 9/005
10,066,878 B2 * 9/2018 Huang ..... F25B 40/00
10,151,541 B2 * 12/2018 Kim ..... F25B 40/00
2003/0010483 A1 1/2003 Ikezaki
2006/0174611 A1 8/2006 Dilley et al.
2007/0084809 A1 * 4/2007 Bradu ..... F28D 9/005 211/59.4
2007/0261833 A1 * 11/2007 Yang ..... F28D 9/005 165/167
2008/0105416 A1 * 5/2008 Katoh ..... F28D 1/0333 165/151
2008/0210410 A1 * 9/2008 Kalbacher ..... F01M 5/002 165/157
2008/0216996 A1 9/2008 Risberg et al.
2010/0243200 A1 * 9/2010 Baker, Jr. ..... B60H 1/00342 165/41
2012/0205085 A1 * 8/2012 Ariyama ..... F28F 3/027 165/181
2012/0234523 A1 9/2012 Jouanny et al.
2013/0306283 A1 11/2013 Bader
2014/0116649 A1 5/2014 Cho
2014/0224455 A1 * 8/2014 Kalbacher ..... F25B 39/04 165/104.21
2016/0061531 A1 3/2016 Lv et al.
2016/0209119 A1 * 7/2016 Martin ..... F28F 21/06

FOREIGN PATENT DOCUMENTS

CN 103759560 A 4/2014
CN 203561269 U 4/2014
CN 103868394 A 6/2014
CN 203980964 U 12/2014
CN 104567509 A 4/2015
JP 10103883 A 4/1998
JP H10300384 A 11/1998
JP 2001-280888 A 10/2001
KR 10-2008-0104559 A 12/2008
WO WO 94/14021 A1 6/1994
WO WO 2012/105888 A1 8/2012

OTHER PUBLICATIONS

Chinese 1st Office Action dated Jan. 3, 2019 in connection with Chinese Application No. 201510405114.9.
CN201410428901.0, Jul. 6, 2018, Chinese 1st Office Action.
CN201510405114.9, Jan. 3, 2019, Chinese 1st Office Action.
Extended European Search Report, dated Jan. 7, 2016, from corresponding European Application No. 15182352.3.
Amano, JP 10-103883, Apr. 24, 1998, Machine Translation.

* cited by examiner

HEAT EXCHANGER

CROSS-REFERENCE TO RELATED APPLICATIONS

This application is a division of U.S. application Ser. No. 14/835,237, filed on Aug. 25, 2015, which application claims the benefit of priorities to Chinese Patent Application No. 201410428901.0 titled "HEAT EXCHANGER", filed with the Chinese State Intellectual Property Office on Aug. 27, 2014, Chinese Patent Application No. 201510405114.9 titled "HEAT EXCHANGER", filed with the Chinese State Intellectual Property Office on Jul. 9, 2015, Chinese Patent Application No. 201520500338.3 titled "HEAT EXCHANGER", filed with the Chinese State Intellectual Property Office on Jul. 9, 2015, and Chinese Patent Application No. 201520499659.6 titled "HEAT EXCHANGER", filed with the Chinese State Intellectual Property Office on Jul. 9, 2015, the entire disclosures of which are incorporated herein by reference.

TECHNICAL FIELD

The present application relates to the field of heat exchanging technology, and particularly to a heat exchanger.

BACKGROUND

A plate heat exchanger is defined as a heat exchanger having a heat transfer element composed of plates, the plates are the core component of the plate heat exchanger, and the common types of fins include a herringbone corrugation, a horizontal straight corrugation, a ball-shaped corrugation, an oblique corrugation and an upright corrugation, and etc. For enhancing the heat exchanging effect of the plate heat exchanger, the structure of the plate of the plate heat exchanger is continuously developed and improved.

Compared with the conventional heat exchanger, the plate heat exchanger has a very compact structure, the plate heat exchanger is generally made from aluminium alloy, thus is very light, and since the thermal conductivity of the plate is high, the plate heat exchanger has a very high efficiency. Therefore, the plate heat exchanger is highly adaptable, and may be adapted to the heat exchange between various fluids and the phase-change heat exchange with state changing. By arranging and combining flow passages, the plate heat exchanger can be adapted to various heat-exchange working conditions, such as a counter current flow, a cross flow, a multi-stream flow, and a multi-pass flow. Through the combination of a series connection, a parallel connection and a serial-parallel connection of the units, the heat exchanging requirements of large equipments may be satisfied.

Currently, the plate heat exchanger is widely used in air separation plants, petrochemical industry, refrigeration and low temperature field, vehicles and aircraft industries, and other fields.

With the continuous increase of the operating requirement for the heat exchanger, the heat exchanging performance of the plate heat exchanger is also required to be further enhanced. Thus the structure of the plate heat exchanger needs to be optimized, to obtain a plate heat exchanger with a high machining qualification rate, a low production cost and a strong heat exchanging performance.

Since external pipelines of the plate heat exchanger are directly in communication with internal flow passages of the plate heat exchanger, an external fluid directly flows into a distribution flow passage inside the plate heat exchanger, and when a gas-liquid two-phase fluid with low temperature and low pressure enters the distribution flow passage of the plate heat exchanger via the external pipelines, the flow velocity of the fluid may be decreased, and the flow condition of the fluid may be changed with the flow velocity. In the distribution flow passage, the gas-liquid stratification phenomenon of the fluid is aggravated, thus for the fluids flowing into the various flow passages between the plates, some of the fluids contain more gas and some of the fluids contain more liquid, which further decreases the distribution uniformity of the fluid in the flow passages, and reduces the heat exchanging performance of the plate heat exchanger.

Therefore, a technical issue to be addressed presently is to provide a plate heat exchanger, to prevent the gas-liquid stratification of fluid from being aggravated and improve the distribution uniformity of the fluid in the flow passages.

SUMMARY

For addressing the above technical issue, a heat exchanger is provided by the present application, which can effectively solve the above technical issue.

The heat exchanger according to the present application includes a first pipe, a second pipe, a third pipe, a fourth pipe and a heat exchanger core, wherein the heat exchanger core includes a plurality of first plates and a plurality of second plates which are alternately stacked together, the first plates and the second plates cooperate with each other to form a plurality of first flow passages and a plurality of second flow passages, and the first flow passages and the second flow passages are spaced from each other. Each of the first plates includes a first orifice and a second orifice, each of the second plates includes a first orifice and a second orifice, the first orifices of the first plates and the first orifices of the second plates are in communication with each other to form a first passage, the second orifices of the first plates and the second orifices of the second plates are in communication with each other to form a second passage, and the first passage and the second passage are in communication with each other via the first flow passages or the second flow passages to form a first fluid passage. The first passage is in communication with the first pipe, and the second passage is in communication with the second pipe. At least one damping structure is provided in the first fluid passage, and at least a part of the first fluid passage is in communication with the first pipe or the second pipe via the damping structure, an equivalent inner diameter of the damping structure is smaller than an equivalent inner diameter of each of the first orifices of the first plates and the second plates or an equivalent inner diameter of each of the second orifices of the first plates and the second plates, or, a circulation area of the damping structure is smaller than a circulation area of each of the first orifices of the first plates and the second plates or a circulation area of each of the second orifices of the first plates and the second plates.

DETAILED DESCRIPTION

A heat exchanger is provided according to the present application, and by providing a damping structure in a plate heat exchanger, the gas-liquid stratification phenomenon of refrigerant in a distribution passage may be restrained, and the distribution uniformity of the refrigerant in the refrigerant passages inside a heat exchanger core is improved, thereby improving the heat exchanging performance of the heat exchanger.

In this specification, a diameter of a circle, the area of which is equal to the area of an orifice, is defined as an equivalent diameter of the orifice; a distance between a center of a first orifice and a center of a second orifice of the plate is defined as a length L of a heat exchanging area of the plate, a distance between the center of the first orifice and a center of a fourth orifice of the plate is defined as a width W of the heat exchanging area of the plate, and a distance between two side plates in the stacking direction of the plates is defined as a thickness D of the heat exchanger. A first flow passage is a passage formed between two adjacent plates and configured to allow one medium to flow through. A second flow passage is a passage formed between two adjacent plates and configured to allow another medium to flow through. The first flow passage and the second flow passage are spaced from each other and are not in communication with each other.

Embodiments of the present application are described in conjunction with drawings hereinafter.

Figure 1:
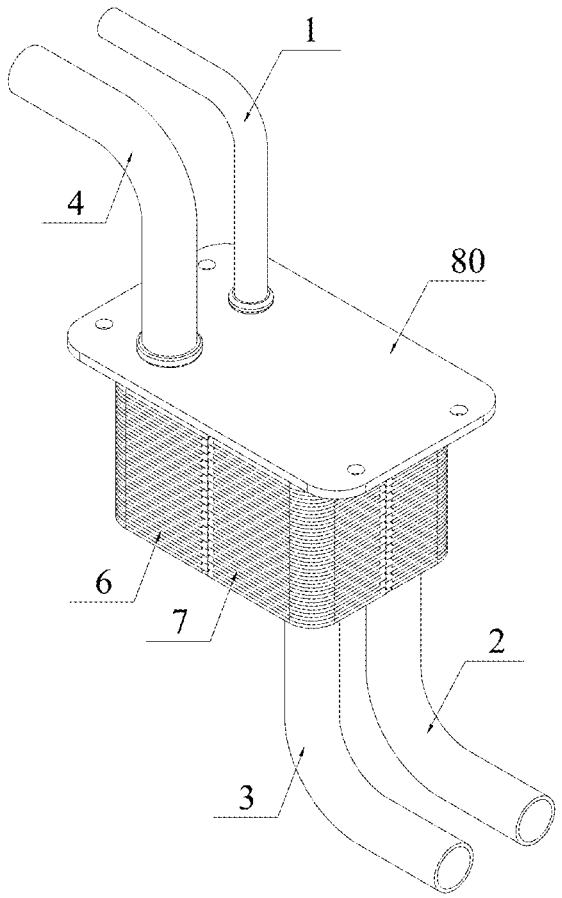
FIG. 1 is a perspective schematic view of an embodiment of a heat exchanger according to the present application.
Figure 2:
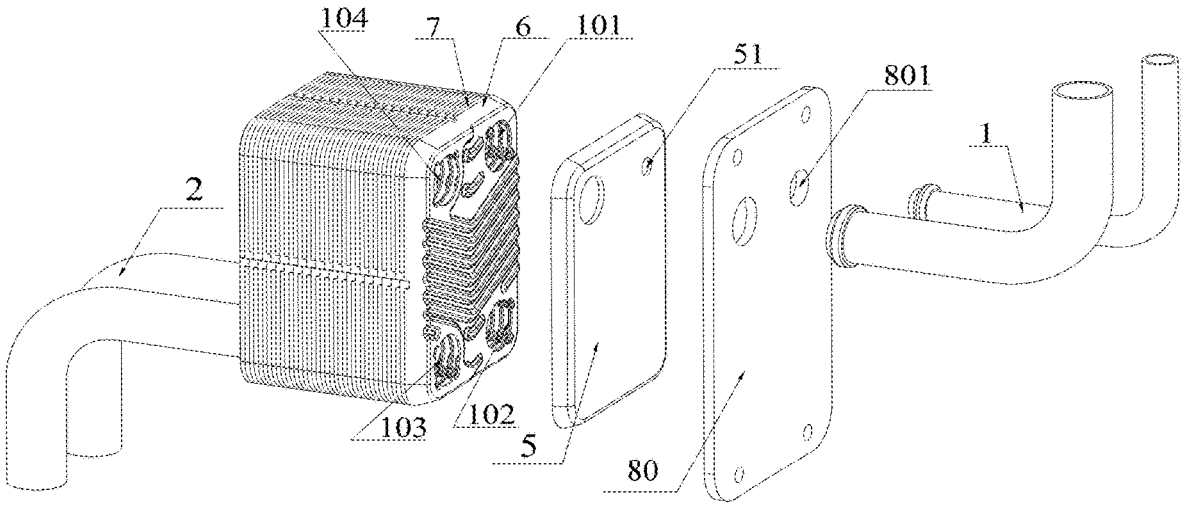
FIG. 2 is a partially exploded schematic view of the heat exchanger in FIG. 1.
Figure 3:
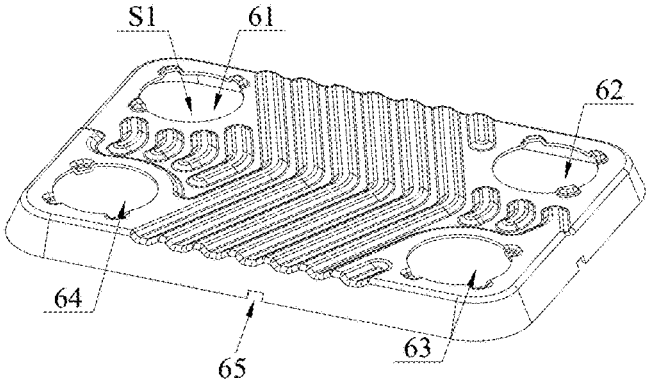
FIG. 3 is a schematic view showing a first plate of the heat exchanger in FIG. 1.
Figure 4:
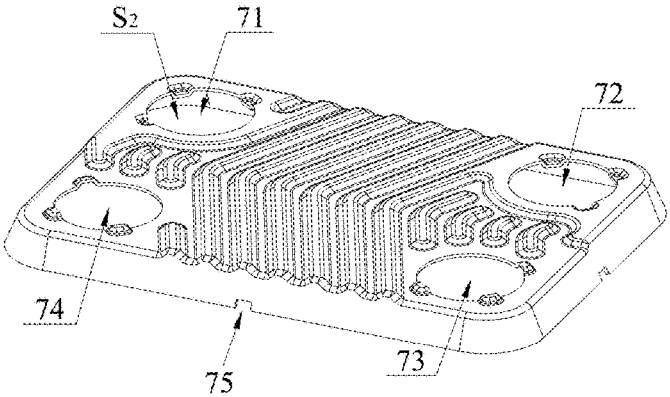
FIG. 4 is a schematic view showing a second plate of the heat exchanger in FIG. 1.
Figure 5:
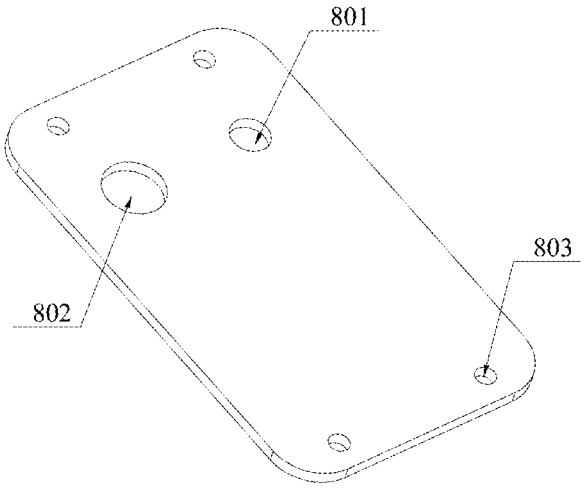
FIG. 5 is a schematic view showing the structure of a mounting plate in FIG. 2.
Figure 6:
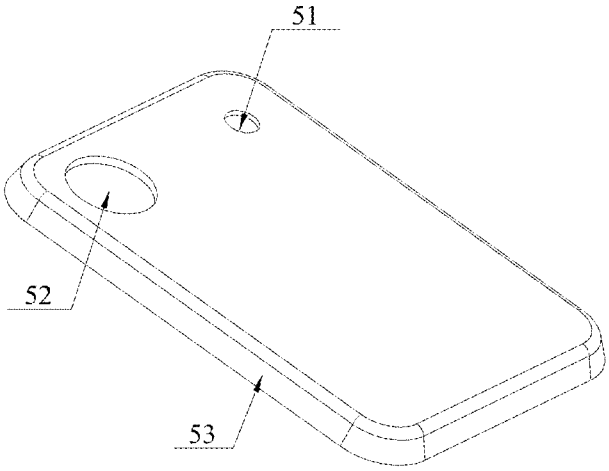
FIG. 6 is a schematic view showing the structure of a side plate in FIG. 2.

FIG. 1 is a perspective schematic view of an embodiment of a heat exchanger according to the present application. As shown in FIG. 1, the heat exchanger in this embodiment includes a plurality of first plates 6 and a plurality of second plates 7 which are alternately stacked together. A first flow passage or a second flow passage is formed between each of the first plates 6 and the second plates 7 adjacent to the first plates 6, and the first flow passage and the second flow passage are spaced from each other and are not in communication with each other. The plurality of first plates 6 and the plurality of second plates 7, which are alternately stacked together, are assembled to form a heat exchanger core. To improve the flow disturbance performance of the fluid in the first flow passage and the second flow passage, fins may be provided in the first flow passage and/or the second flow passage, or the first plates 6 and the second plates 7 may each be embodied as a concave-convex structure of a corrugation shape or a dimple shape.

As shown in the figure, each of the first plates 6 includes a plate plane and a flanging structure encircling the plate plane, four orifices are provided at four corners of the plate plane and include a first orifice 61, a second orifice 62, a third orifice 63 and a fourth orifice 64, and a first notch 65 is provided in the flanging structure.

Each of the second plates 7 includes a plate plane and a flanging structure encircling the plate plane, four orifices are provided at four corners of the plate plane and include a first orifice 71, a second orifice 72, a third orifice 73 and a fourth orifice 74, and a second notch 75 is provided in the flanging structure. In the heat exchanger core, all of the first notches 65 are substantially located in one straight line, all of the second notches 75 are also substantially located in one straight line, each of the first notches 65 is located at a left side or a right side of each of the second notches 75, and the first notches 65 are staggered from the second notches 75, thus mounting positions of the first plates 6 and the second plates 7 can be determined from an outside of the heat exchanger, which facilitates assembly of the first plates 6 and the second plates 7, and prevents the first plates 6 and the second plates 7 from being mistakenly assembled.

The first orifice 61, the second orifice 62, the third orifice 63 and the fourth orifice 64 of each of the first plates 6 are respectively arranged corresponding to the first orifice 71, the second orifice 72, the third orifice 73 and the fourth orifice 74 of each of the second plates 7. Further, the first plates 6 and the second plates 7 may be embodied as plates of same shape and structure, and in the heat exchanger core, the first plates 6 are rotated by 180 degrees with respect to the second plates 7. As shown in Figures, the heat exchanger further includes a first side plate 5 and a second side plate located at an outer side of the heat exchanger in a stacking direction of the first plates 6 and the second plates 7. One side of the first side plate 5 is fixed to the first plate 6 or the second plate 7 by welding or other ways. Another side of the first side plate 5 may also be fixed to a mounting plate 80 by welding or other ways. The first side plate 5 is provided with a damping structure in communication with a first passage 101.

In this embodiment, the damping structure in the first side plate 5 is embodied as a first communicating hole 51. The first side plate 5 is provided with the first communicating hole 51 corresponding to the first passage 101 and a second communicating hole 52 corresponding to a fourth passage 104, and the first communicating hole 51 has an inner diameter less than an inner diameter of the first orifice, and the inner diameter of the first communicating hole 51 may be even less than a half of the inner diameter of the first orifice.

The mounting plate 80 is provided with a first connecting hole 801 and a second connecting hole 802 corresponding to the first communicating hole 51 and the second communicating hole 52 respectively. The number of the connecting holes in the mounting plate 80 is not limited to two, and in the case that the second side plate is not provided with a hole, the number of the connecting holes in the mounting plate 80 is four. The mounting plate 80 may also be provided with a plurality of mounting holes 803, and of course, may be provided with other mounting structures (such as a buckle).

The first plates 6 and the second plates 7 are spaced from each other to form the heat exchanger core, the first orifices 61 and 71 and the first communicating hole 51 are in communication with each other to form the first passage 101, the second orifices 62 and 72 are in communication with each other to form the second passage 102, the third orifices 63 and 73 are in communication with each other to form a third passage 103, and the fourth orifices 64 and 74 are in communication with each other to form the fourth passage 104. In this embodiment, the first passage 101 and the second passage 102 are in communication with each other via the first flow passage, and the third passage 103 and the fourth passage 104 are in communication with each other via the second flow passage. Of course, in other embodiments, the first passage 101 may be in communication with the third passage 103, and the second passage 102 may be in communication with the fourth passage 104, or the communication between the passages 101, 102, 103, and 104 may be implemented in other manners, and the relationship between a distribution passage and the passage may be determined according to actual requirements and the structure of the plate, which is not limited herein.

In this embodiment, a first fluid passage allowing the refrigerant to flow includes the first passage 101, the first flow passage and the second passage 102. A second fluid passage allowing a cooling liquid to flow includes the third passage 103, the second flow passage and the fourth passage 104.

The heat exchanger further includes a first pipe 1 in communication with the first passage 101, a second pipe 2 in communication with the second passage 102, a third pipe 3 in communication with the third passage 103, and a fourth pipe 4 in communication with the fourth passage 104. In this embodiment, the first pipe 1 may be fixed to the mounting plate 80 by welding or other ways, in this case, one end of the first pipe 1 has at least a part extending into the first connecting hole 801, and the part extending into the first connecting hole 801 is in an interference fit with the first connecting hole 801 and has a length less than or equal to a depth of the first connecting hole 801. Further, a part of the first pipe 1, which is connected to the part extending into the first connecting hole 801, is provided with an annular first position-limiting portion 12, and the first position-limiting portion 12 is in contact with a mounting surface of the mounting plate 80. The first position-limiting portion 12 has an outer diameter greater than an inner diameter of the first connecting hole 801. In this way, by arranging the first position-limiting portion 12, on one hand, the length of the part of the first pipe 1 that is extending into the first connecting hole 801 is controlled, which realizes the positioning function and facilitates the assembly; and on the other hand, a contact area between the first pipe 1 and the mounting plate 80 is increased, which improves the mounting stability of the first pipe 1.

The fourth pipe 4 may be fixed to the mounting plate 80 by welding or other ways, and the second pipe 2 and the third pipe 3 may be fixed to the second side plate by welding or other ways. In this embodiment, the structures and mounting manners of the second pipe 2, the third pipe 3 and the fourth pipe 4 are identical to or similar to the structure and mounting manner of the first pipe 1, thus will not be described in detail hereinafter.

Figure 7:
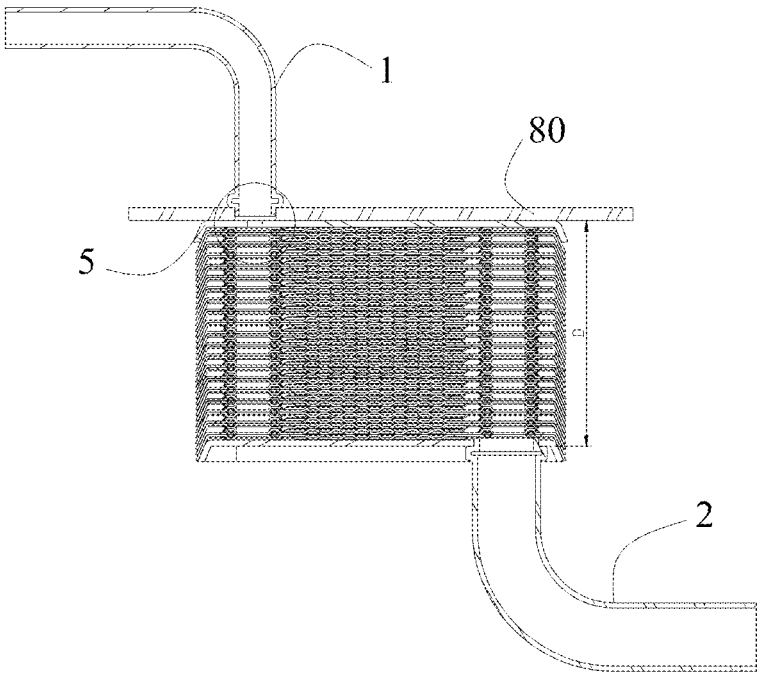
FIG. 7 is a sectional schematic view of the heat exchanger in FIG. 1.
Figure 8:
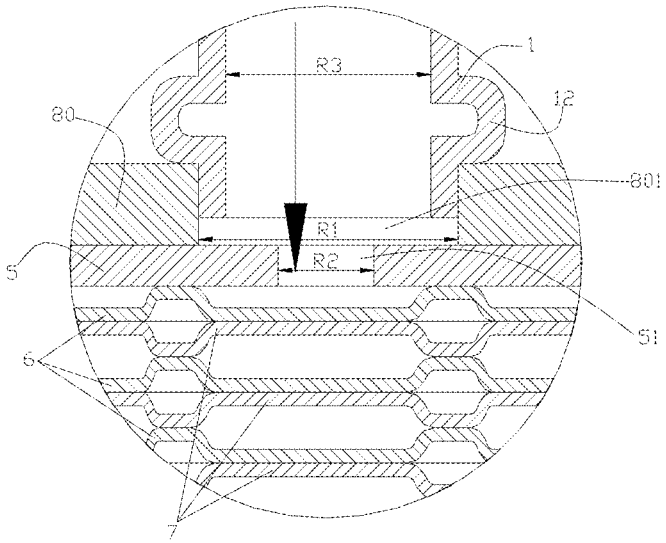
FIG. 8 is a partially enlarged schematic view of the mounting plate in FIG. 5.
Figure 9:
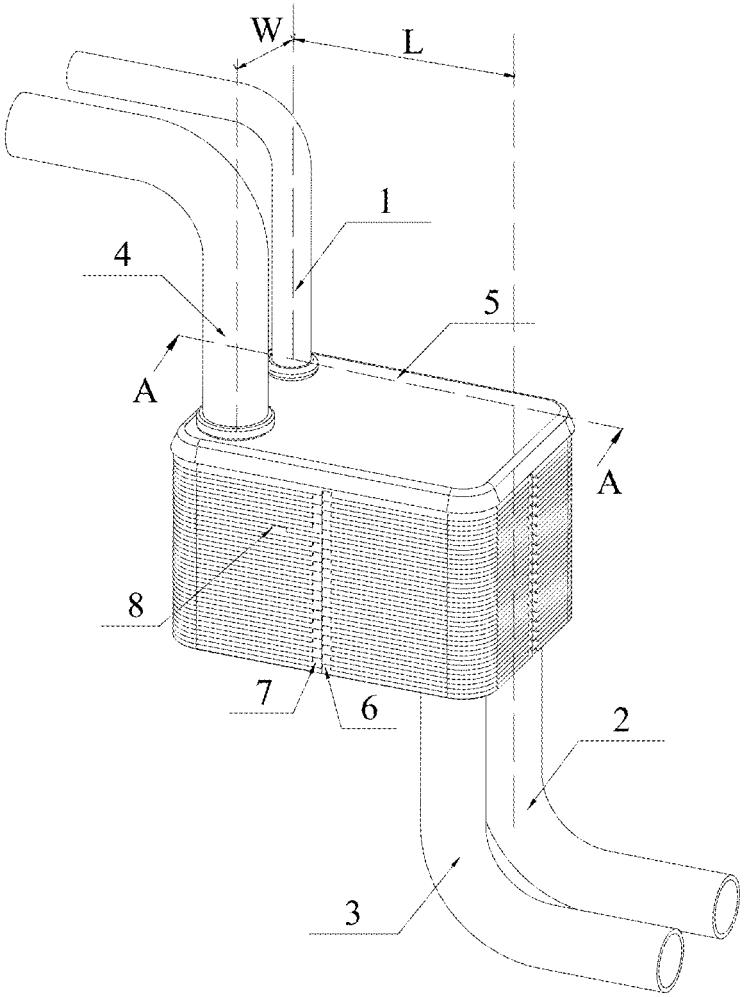
FIG. 9 is a perspective schematic view of another embodiment of a heat exchanger according to the present application.
Figure 10:
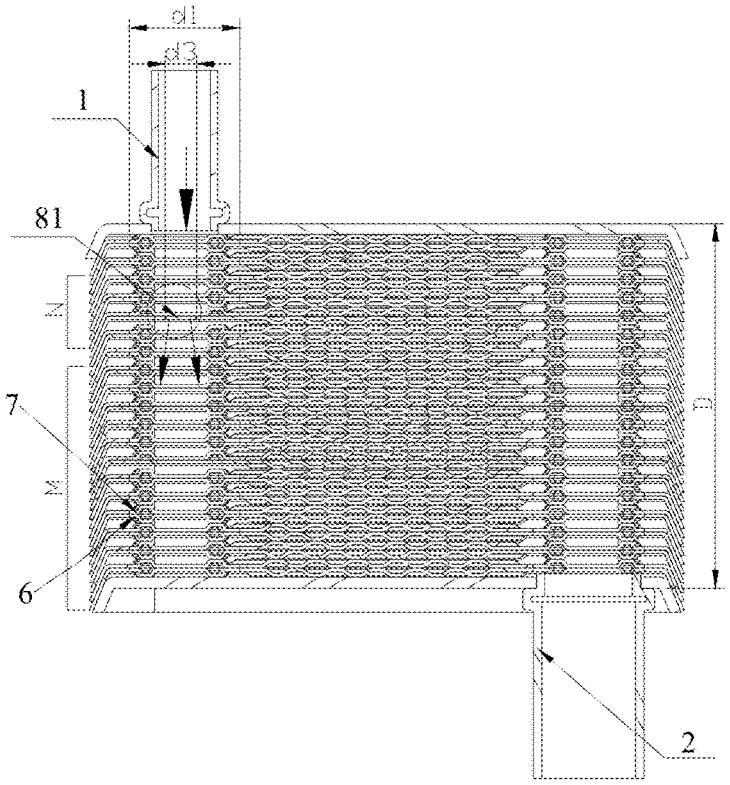
FIG. 10 is a sectional schematic view of the heat exchanger in FIG. 9.
Figure 11:
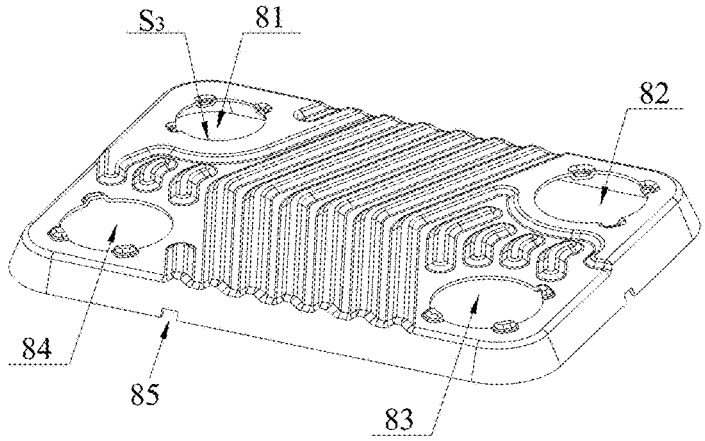
FIG. 11 is a schematic view showing the structure of a third plate of the heat exchanger in FIG. 9.
Figure 12:
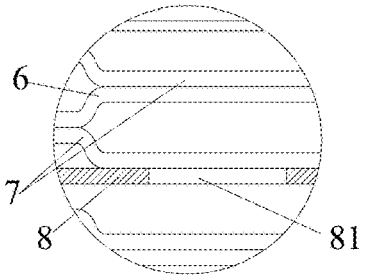
FIG. 12 is a partially enlarged schematic view of the heat exchanger in FIG. 9.

As shown in FIGS. 7 and 8, the first pipe 1 is in communication with the first passage 101 via the first connecting hole 801 and the first communicating hole 51, and an inner diameter R2 of the first communicating hole 51 is less than an inner diameter R1 of the first connecting hole 801, is also less than an inner diameter R3 of a main body portion of the first pipe, and is meanwhile less than an equivalent inner diameter of the first orifice. The value of the inner diameter R2 of the first communicating hole 51 may range from 1.5 mm to 5.5 mm, and further, the value of the inner diameter R2 of the first communicating hole 51 may range from 2 mm to 5 mm. When the inner diameter R2 of the first communicating hole 51 is in the above range, the heat exchanging performance of the heat exchanger can be remarkably improved. The first communicating hole may be of a circular shape, or may be of one or more shapes of an oval shape, a square shape, a triangular shape, and etc.

It should be noted that, the main body portion of the first pipe is a portion configured to convey fluid and doesn't include other functional portions including the first position-limiting portion 12. Further, multiple first communicating holes 51 may be provided, and the sum of areas of the multiple first communicating holes 51 should be less than each of an area corresponding to the inner diameter R1 of the first connecting hole 801 and an area corresponding to the equivalent inner diameter of the first orifice.

When the gas-liquid two-phase fluid flows into the heat exchanger via the first pipe 1, since the first pipe 1 is long, a gas-liquid stratification phenomenon of the fluid may occur, and the velocity of the fluid may also be decreased. In the case that the inner diameter R2 of the first communicating hole 51 is less than the inner diameter R3 of the main body portion of the first pipe, due to the first communicating hole 51, when the fluid passes through the first communicating hole 51, on the one hand, big bubbles in the fluid are broken by the first communicating hole 51 having a small inner diameter, which allows the gaseous fluid and liquid fluid to be uniformly mixed again, and on the other hand, since the inner diameter R2 of the first communicating hole 51 is less than the inner diameter R3 of the main body portion of the first pipe, when the fluid passes through the first communicating hole 51, the velocity of the fluid may be increased, which increases the turbulence degree of the fluid, and effectively prevents the velocity of the fluid from being further decreased when flowing into the distribution passage in which case the gas-liquid stratification may be aggravated, thereby effectively restraining the gas-liquid stratification phenomenon, allowing the gas-liquid two-phase fluid to be uniformly distributed into the circulating passages between the plates, and improving the heat exchanging performance of the heat exchanger.

Further, in the stacking direction of the plates, the first pipe 1 and the second pipe 2 are respectively arranged at two opposite sides of the heat exchanger, and a length L of a heat exchanging area of the heat exchanger and a thickness D of the heat exchanger satisfy the relationship: $1 \leq L/D \leq 5$.

Under the circumstance that the heat exchanging performances are the same, if the value of L/D is small, namely the thickness of the heat exchanger is large, since the first passage 101 is long, the gas-liquid separation of the refrigerant tends to occur inside the first passage 101, which may cause a nonuniform distribution of the refrigerant, and result in a poor heat exchanging performance of the heat exchanger. In this embodiment, by arranging the first communicating hole 51 having the damping function, the gas-liquid separation of the refrigerant may be effectively restrained, thereby improving the heat exchanging performance of the heat exchanger.

Another embodiment according to the present application is shown in FIGS. 9 to 12, and in this embodiment, the heat exchanger core further includes at least one third plate 8, and a first flow passage and a second flow passage are also formed between the third plate 8 and the first plate 6 or between the third plate 8 and the second plate 7. The third plate 8 includes a plate plane and a flanging structure encircling the plate plane, and four orifices are provided in four corners of the plate plane respectively and include a first orifice 81, a second orifice 82, a third orifice 83 and a fourth orifice 84, and a third notch 85 is provided in the flanging structure.

The first orifice 61 of the first plate 6 has an area S1, and an equivalent diameter d1, the first orifice 71 of the second plate 7 has an area S2 and an equivalent diameter d2, and the first orifice 81 of the third plate 8 has an area S3 and an equivalent diameter d3. The value of S1 is substantially equal to the value of S2, the value of S3 is less than a minimum value of S1 and S2, that is, $S3<MIN(S1,S2)$, and $d3<MIN(d1,d2)$, thus the first orifice 81 of the third plate 8 functions as a damping hole. The second orifice 82, the third orifice 83 and the fourth orifice 84 of the third plate 8 are arranged corresponding to the second orifices, the third orifices and the fourth orifices of the first plates 6 and the second plates 7.

In the heat exchanger core, the third notch 85 is not located in the straight line formed by connecting all the first notches 65, and is also not located in the straight line formed by connecting all the second notches 75, that is, the third notch 85 is staggered with respect to the first notches 65 and the second notches 75, in this way, the mounting position of the third plate 8 may be determined from the outside of the heat exchanger, which facilitates mounting the plate and preventing the plate being mistakenly mounted.

Further, in the heat exchanger core, an average area of the first orifices 61 of the first plates 6 and the second orifices 71 of the second plates 7 is S, and $0.01 \le S3/S \le 0.5$. In the case that S3/S is in the above range, on one hand, when the refrigerant is passing through the first orifice 81, big bubbles in the refrigerant are broken by the first orifice 81 having a small diameter, which may allow the gaseous refrigerant and liquid refrigerant to be uniformly mixed again; and on the other hand, the first orifice 81 of the third plate 81 can have a good damping effect and allow the flowing state of the gas-liquid two-phase refrigerant to be turbulent, to restrain the gas-liquid stratification phenomenon, thereby improving the distribution uniformity of the gas-liquid two-phase refrigerant in the first flow passages, and further improving the heat exchanging performance of the heat exchanger. Further, S3/S may satisfy the relationship: $0.05 \le S3/S \le 0.3$.

As shown in the Figures, the first plates 6, the second plates 7, and the third plate 8 cooperate with each other to form the heat exchanger core, the first orifices 61, 71, 81 of the first plates 6, the second plates 7 and the third plate 8 are in communication with the first communicating hole 51 to form a first passage 101. The second orifices 62, 72, 82 of the first plates 6, the second plates 7 and the third plate 8 are in communication with each other to form a second passage 102. The third orifices 63, 73, 83 of the first plates 6, the second plates 7 and the third plate 8 are in communication with each other to form a third passage 103. The fourth orifices 64, 74, 84 of the first plates 6, the second plates 7 and the third plate 8 are in communication with each other to form a fourth passage 104.

The heat exchanger core includes a first heat exchanging unit N and a second heat exchanging unit M which are divided by the third plate 8. And the first heat exchanging unit N includes one or more first flow passages, and the second heat exchanging unit M includes one or more first flow passages. One part of the refrigerant passing through the first passage 101 flows into the first heat exchanging unit N, and another part thereof passes through the first orifice 81 of the third plate 8 and then flows into the second heat exchanging unit M. In this way, since S3 satisfies the relationship of $S3<MIN(S1, S2)$, when the refrigerant flows into the first passage 101 via the first pipe 1, not only the gas-liquid stratification phenomenon caused by the inlet pipe being long can be restrained, but also the gas-liquid stratification phenomenon of the refrigerant inside the heat exchanger caused by the action of gravity can be restrained, thus the gaseous refrigerant and liquid refrigerant are uniformly mixed, and the turbulence degree of the flowing state of the refrigerant is improved, in this way, the refrigerant can uniformly flow into each of the first flow passages, and the distribution uniformity of the refrigerant is improved, which further improves the heat exchanging performance of the heat exchanger.

In this embodiment, the first heat exchanging unit N includes n1 first flow passages, and the second heat exchanging unit M includes n2 first flow passages. The second heat exchanging unit M is located in a direction away from the first pipe 1, and $0.2 \le n1/n2 \le 5$, and in the case that n1/n2 is in the above range, the heat exchanging performance of the heat exchanger is high. Further, in the case that n1/n2 satisfies the relationship of $0.3 \le n1/n2 \le 3$, the heat exchanging performance of the heat exchanger is better.

The value of the equivalent diameter d3 of the first orifice 81 of the third plate 8 may range from 1.5 mm 5.5 mm, further, the value of the equivalent diameter d3 of the first orifice 81 may range from 2 mm to 5 mm, and the heat exchanging performance of the heat exchanger can be remarkably improved in the case that the value of the equivalent diameter d3 of the first orifice 81 is in the above ranges. The first orifice 81 may be of a circular shape, or may be of one or more shapes of an oval shape, a square shape, a triangular shape, and etc., or may consist of many small holes.

Further, in the stacking direction of the plates, the first pipe 1 and the second pipe 2 are respectively arranged at two opposite sides of the heat exchanger, and a length L of a heat exchanging area of the heat exchanger and a thickness D of the heat exchanger satisfies the relationship of $1 \le L/D \le 5$. Thus, under the circumstance that the heat exchanging performances are the same, if the value of L/D is small, namely the thickness of the heat exchanger is large, the gas-liquid separation of the refrigerant tends to occur inside the first passage 101 since the first passage 101 is long, which may cause a nonuniform distribution of the refrigerant, and result in a poor heat exchanging performance of the heat exchanger. In this embodiment, by arranging the third plate 8 having the damping function, the gas-liquid separation of the refrigerant may be effectively decreased, thereby improving the heat exchanging performance of the heat exchanger.

Figure 13:
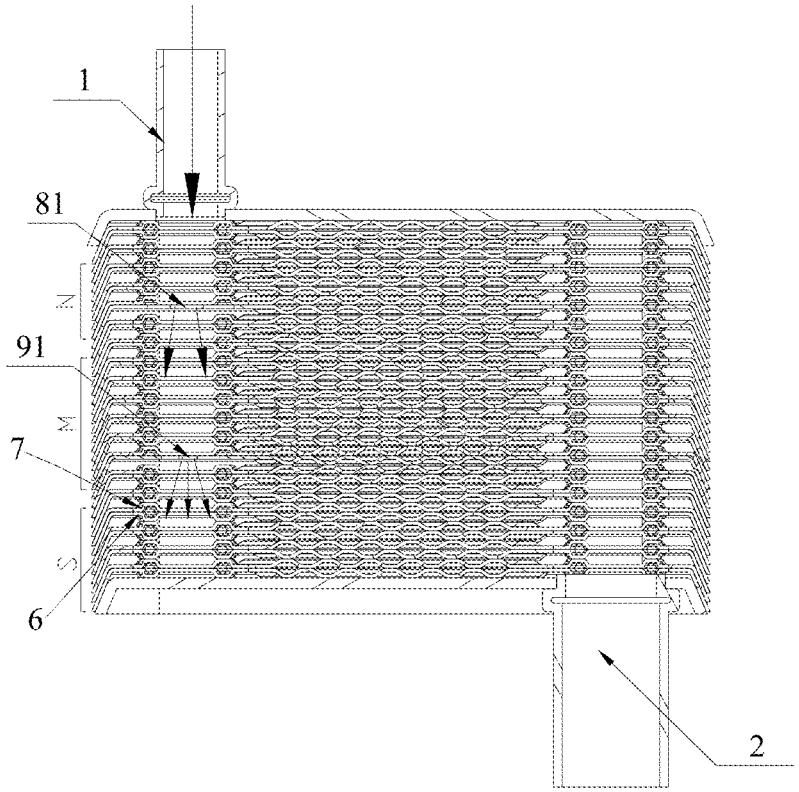
FIG. 13 is a sectional schematic view of another embodiment of the heat exchanger according to the present application.
Figure 14:
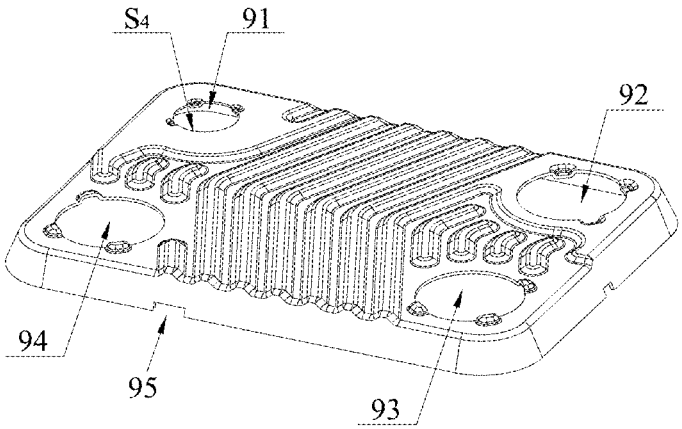
FIG. 14 is a schematic view showing the structure of a fourth plate of the heat exchanger in FIG. 13.

Another embodiment according to the present application is shown in FIGS. 13 and 14, and as shown in FIGS. 13 and 14, the heat exchanger core may be further provided with a fourth plate 9. The fourth plate 9 includes a plate plane and a flanging structure encircling the plate plane, and four orifices are provided in four corners of the plate plane respectively and include a first orifice 91, a second orifice 92, a third orifice 93 and a fourth orifice 94, and a fourth notch 95 is provided in the flanging structure. The first orifice 91 has an area S4 and an equivalent diameter d4, and S4≤S3, and d4≤d3, thus the first orifice 91 may function as a damping hole. In the heat exchanger core, the fourth notch 95 is located at a left side or a right side of the third notch, and is not located in the straight line formed by connecting the first notches 65 of the first plates and is also not located in the straight line formed by connecting the second notches 75 of the second plates. In this way, the mounting position of the fourth plate 9 can be determined from the outside of the heat exchanger, which facilitates mounting the plate and prevents the plate from being mistakenly mounted.

In the heat exchanger core, an average area of the first orifices 61 of all the first plates 6 and the first orifices 71 of all the second plates 7 is S, an average area of the first orifice 81 of the third plate 8 and the first orifice 91 of the fourth plate 9 is A, and A and S satisfy the relationship of $0.01 \leq A/S \leq 0.5$. When A/S is in the above range, on one hand, when the refrigerant is passing through the first orifice 81 and the first orifice 91, big bubbles in the refrigerant are broken by the first orifice 81 and the first orifice 91 both having a small inner diameter, the gaseous refrigerant and liquid refrigerant can be uniformly mixed again; and on the other hand, the first orifices of the third plate 8 and the fourth plate 9 may have a good damping effect, which allows the flowing state of the gas-liquid two-phase refrigerant to be turbulent, and restrains the gas-liquid stratification phenomenon, thereby improving the distribution uniformity of the gas-liquid two-phase refrigerant in the first flow passages, and further improving the heat exchanging performance of the heat exchanger. Further, A/S may satisfy the relationship of $0.05 \leq A/S \leq 0.3$.

The heat exchanger core includes a first heat exchanging unit N, a second heat exchanging unit M and a third heat exchanging unit S which are divided by the third plate 8 and the fourth plate 9. And the first heat exchanging unit N includes one or more first flow passages, the second heat exchanging unit M includes one or more first flow passages, and the third heat exchanging unit S also includes one or more first flow passages. In the heat exchanger core, the first heat exchanging unit N includes n1 first flow passages, the second heat exchanging unit M includes n2 first flow passages, and the third heat exchanging unit S includes n3 first flow passages. And the fourth plate 9 is located at a side, away from the first pipe 1, of the third plate 8, and n1, n2, and n3 satisfy the relationships of $0.2 \leq n1/n2 \leq 5$, and $0.2 \leq n2/n3 \leq 5$. When n1, n2, and n3 satisfy the above relationships, the heat exchanger has a good heat exchanging performance. Further, n1, n2 and n3 may satisfy the relationships of $0.3 \leq n1/n2 \leq 3$, and $0.3 \leq n2/n3 \leq 3$.

Figure 15:
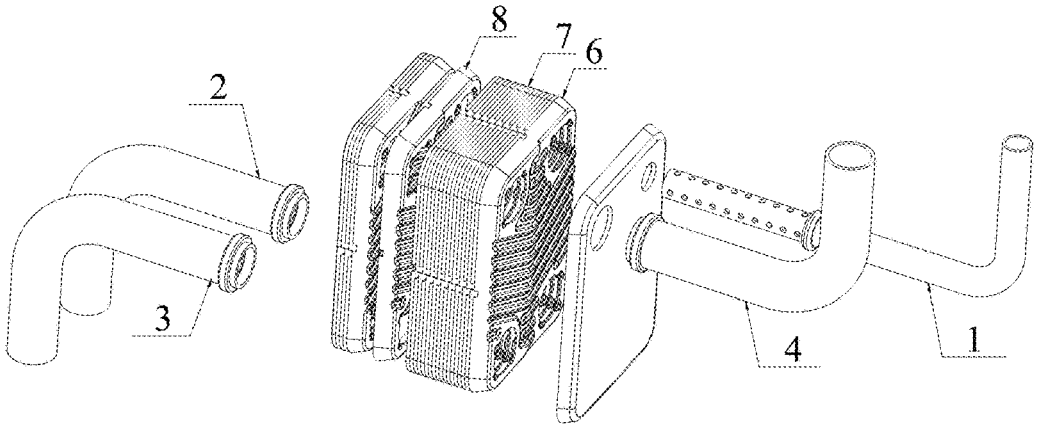
FIG. 15 is a partially exploded schematic view showing another embodiment of the heat exchanger according to the present application.
Figure 16:
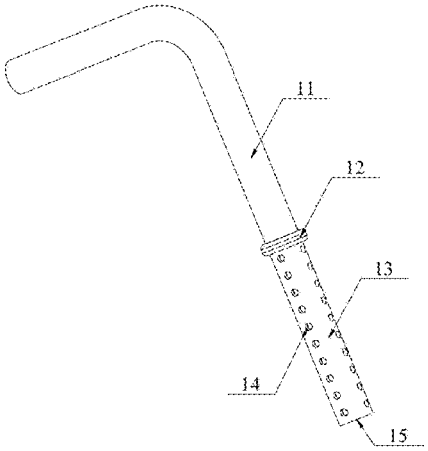
FIG. 16 is a schematic view showing the structures of a first pipe and a distribution pipe of the heat exchanger in FIG. 15.
Figure 17:
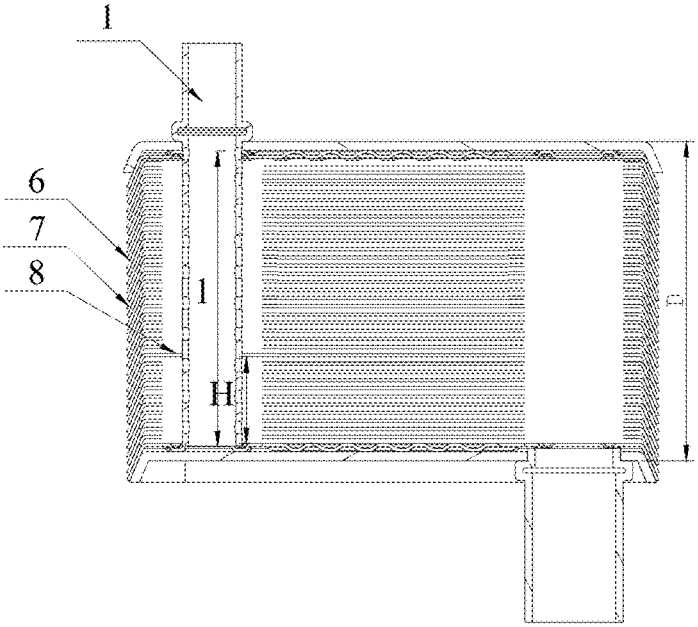
FIG. 17 is a sectional schematic view of the heat exchanger in FIG. 15.

Another embodiment according to the present application is shown in FIGS. 15 to 17. In this embodiment, a distribution pipe 13 is further provided in the first passage 101, and in the stacking direction of the plates, the first pipe 1 and the second pipe 2 are respectively arranged at two opposite sides of the heat exchanger, and a length L of a heat exchanging area of the heat exchanger and a thickness D of the heat exchanger satisfy the relationship of $1 \leq L/D \leq 5$.

Thus, under the circumstance that the heat exchanging performances are the same, if the value of L/D is small, namely the thickness of the heat exchanger is large, the gas-liquid separation of the refrigerant tends to occur inside the first passage 101 since the first passage 101 is long, which may cause a nonuniform distribution of the refrigerant, and result in a poor heat exchanging performance of the heat exchanger. In this embodiment, by arranging the distribution pipe 13 having a damping function, the gas-liquid separation of the refrigerant may be effectively decreased, thereby improving the heat exchanging performance of the heat exchanger.

As shown in FIG. 15, the first pipe 1 and the distribution pipe 13 are formed integrally, and the first pipe 1 includes a pipe section 11, a first position-limiting portion 12 and the distribution pipe 13. The distribution pipe 13 is provided with a certain number of distribution holes 14, and a sealing structure 15 is provided at an end portion of the distribution pipe 13. With the sealing structure 15, the refrigerant flowing into the distribution pipe 13 from the first pipe 1 flows to the first passage 101 via each of the distribution holes 14. An outer diameter of the first position-limiting portion 12 is greater than each of an outer diameter of the pipe section 11 and an outer diameter of the distribution pipe 13, and the first pipe 1 is fixed to the side plate 5 by welding via the first position-limiting portion 12. And the first position-limiting portion 12 is also configured to determine the position of the distribution pipe 13 inside the heat exchanger core, thus having a positioning function.

Diameters of the distribution holes 14 are progressively increased in a direction towards the first pipe 1, which helps to further improve the distribution uniformity of the refrigerant in the first passage 101, and further improves the heat exchanging performance of the heat exchanger.

The heat exchanger core may be further provided with the third plate 8, and the distribution pipe 13 cooperates with the first orifice 81 of the third plate 8. The distribution pipe 13 passes through the first orifice 81 of the third plate 8 and the position of the distribution pipe 13 is limited by the first orifice 81, the outer diameter of the distribution pipe 13 is slightly smaller than an inner diameter of the first orifice 81, and the distribution pipe 13 is in clearance fit with the first orifice 81. The distribution pipe 13 and the first orifice 81 cooperates with each other to divide the first passage 101 into two portions, and when the refrigerant flows into the first passage 101 via the distribution pipe 13, since the first passage 101 is divided into two portions, the refrigerant cannot freely circulate between the two portions of the first passage 101, that is, the first passage 101 is divided into two parts both having a short flow passage, which can effectively restrain the gas-liquid stratification phenomenon of the refrigerant in the first passage 101. By providing the distribution pipe 13, the gas-liquid separation of the refrigerant in external pipelines may be effectively restrained, and the refrigerant can also be uniformly distributed in the first passage 101, and the distribution uniformity of the refrigerant in the first flow passages can be improved, thereby improving the heat exchanging performance of the heat exchanger. At the same time, the first orifice 81 further has a function of fixing the distribution pipe 13, which prevents the distribution pipe 13 from deviating in the first flow passage.

Further, the number of the third plate 8 may be one or more, and may be determined according to the size of the heat exchanger core. In the heat exchanger core, a vertical distance between the sealing structure 15 of the distribution pipe and the third plate 8 closest to the sealing structure 15 is H, a length of the first passage 101 is 1, and H and 1 here satisfy the relationship of $0.2 \leq H/l \leq 0.5$, and in this case, the gas-liquid stratification phenomenon of the refrigerant in the first passage 101 can be effectively prevented and the distribution uniformity of the refrigerant is improved, and the heat exchanging effect of the heat exchanger is good.

Figure 18:
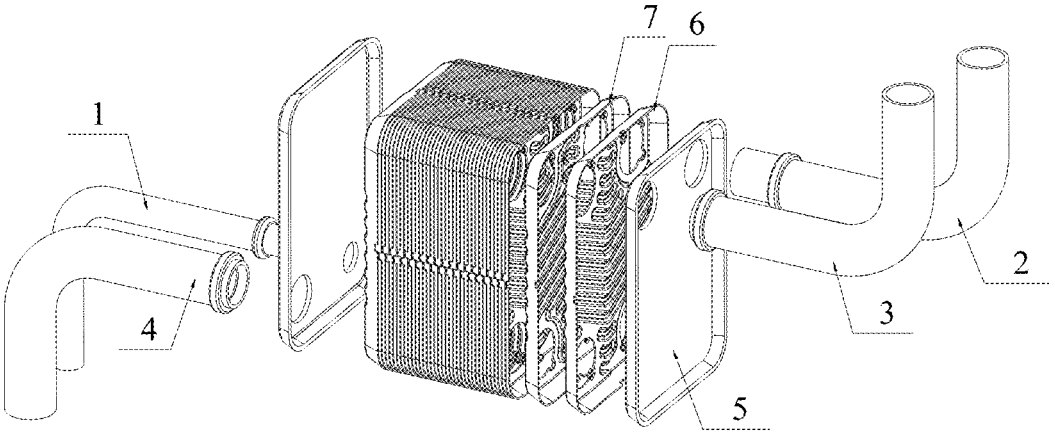
FIG. 18 is a partially exploded schematic view of another embodiment of the heat exchanger according to the present application.
Figure 19:
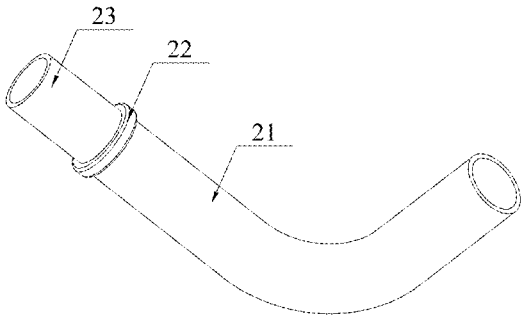
FIG. 19 is a schematic view showing the structures of a first pipe and an inward-extending pipe of the heat exchanger in FIG. 18.
Figure 20:
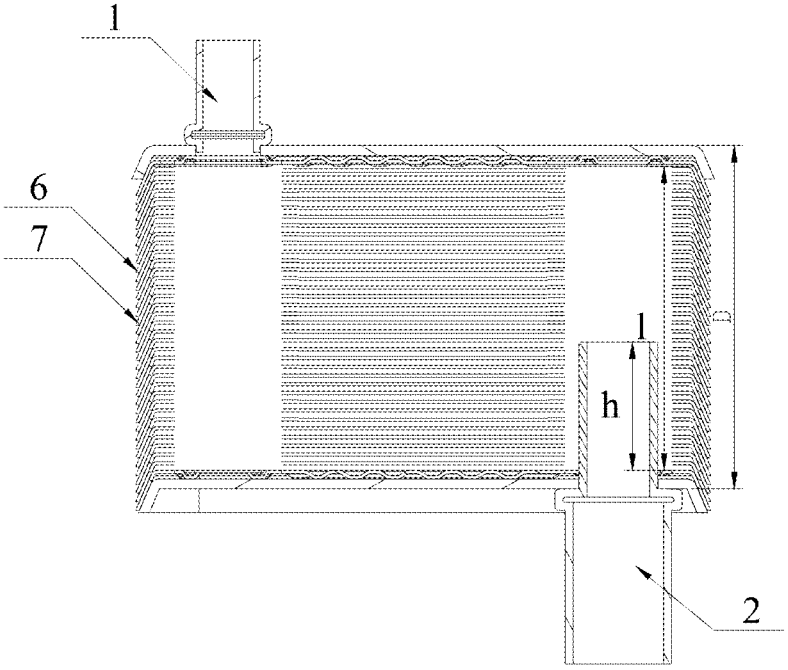
FIG. 20 is a sectional schematic view of the heat exchanger in FIG. 18.

Another embodiment according to the present application is shown in FIGS. 18 to 20. As shown in the Figures, a part of the second pipe 2 extends into the second passage 102, and the second pipe 2 includes a pipe section 21, an assembling structure 22 and an inward-extending pipe 23. An outer diameter of the assembling structure 22 is greater than each of an outer diameter of the pipe section 21 and an outer diameter of the inward-extending pipe 23. The second pipe 2 is fixed to the side plate 5 by welding via the assembling structure 22. The assembling structure 22 is also configured to determine the positions of the inward-extending pipe 23 and the second passage 102, thus having a positioning function. It should be noted that, the inward-extending pipe 23 may also be separately provided inside the second passage 102, and the second passage 102 is in communication with the second pipe 2 via the inward-extending pipe 23.

The gas-liquid two-phase refrigerant may generate a certain gas-liquid stratification phenomenon when flowing into the first passage 101 from the first pipe 1. And since the refrigerant has a certain velocity, the following situation tends to occur, that a side of the first passage 101 away from the first pipe 1 has more liquid refrigerant and another side of the first passage 101 close to the first pipe 1 has more gaseous refrigerant. Thus, in the process of refrigerant flowing to the second passage 102 from the first passage 101, the refrigerant exchanges heat with a cooling liquid circulating between the third passage 103 and the fourth passage 104; and when the refrigerant enters the second passage 102, an unsaturation of the refrigerant is apt to occur at the side having more liquid refrigerant, and an overheating of the refrigerant is apt to occur at the side having more gaseous refrigerant. In the case that the first pipe 1 and the second pipe 2 are respectively arranged at two opposite sides of the heat exchanger in the stacking direction of the plates, in the second passage 102, one side having unsaturated refrigerant is close to the second pipe 2, which may result in that the refrigerant flowing out of the second pipe 2 contains liquid refrigerant, and further result in oscillation of superheat degree of the system or inaccurate measurement.

In this embodiment, an outer diameter of the inward-extending pipe 23 of the second pipe 2 is smaller than an inner diameter of the second passage 102, that is, the outer diameter of the inward-extending pipe 23 is smaller than an inner diameter of the second orifice.

The inward-extending pipe 23 extends into the second passage 102 and is not in contact with the second passage 102, or an outer wall of the inward-extending pipe 23 is spaced from an inner wall of the second passage 102 by a certain distance, and a refrigerant flow passage of the is formed between the outer wall of the inward-extending pipe 23 and the inner wall of the second passage 102. The refrigerant flow passage between the outer wall of the inward-extending pipe 23 and the inner wall of the second passage 102 has a small flowing space with respect to the flowing space of the second passage 102.

Thus although a certain gas-liquid stratification phenomenon of the gas-liquid two-phase refrigerant occurs when the refrigerant flows into the first passage 101 from the first pipe 1, and there is more liquid refrigerant in the first passage 101 at a side away from the first pipe 1 since the refrigerant has a certain velocity, the side having more liquid refrigerant is blocked by the inward-extending pipe 23 when the refrigerant flows from the first passage 101 to the second passage 102, which decreases the flow rate of the refrigerant at the side having more liquid refrigerant, and allows a part of the refrigerant to flow to the second passage 102 from other portions, thereby allowing more refrigerant to be superheated in the process of flowing from the first passage 101 to the second passage 102.

And a part of the refrigerant is required to flow along the refrigerant flow passage between the outer wall of the inward-extending pipe 23 and the inner wall of the second passage 102, and then flow out of the heat exchanger along the inward-extending pipe 23. Due to the inward-extending pipe 23, the turbulence degree of the refrigerant in the second passage 102 can be increased, and since the refrigerant flowing to the second passage 102 all needs to flow out of the heat exchanger via an inlet of the inward-extending pipe 23, the refrigerant can be fully mixed in an inlet area of the inward-extending pipe 23, which allows the remaining liquid refrigerant to exchange heat with overheated gaseous refrigerant to be gasified, thereby reducing the oscillation of overheating degree and improving the heat exchanging performance of the heat exchanger.

Further, in the heat exchanger core, a length of the inward-extending pipe 23 is h, a length of the second passage 102 is 1, h and 1 satisfy the relationship of $0.1 \leq h/l \leq 0.6$, in this case, the oscillation of overheating degree can be effectively decreased, and the performance of the heat exchanger can be improved. Further, h and 1 may satisfy the relationship of $0.3 \leq h/l \leq 0.5$.

Further, a length L of a heat exchanging area of the heat exchanger and a thickness D of the heat exchanger satisfy the relationship of $1 \leq L/D \leq 5$. Thus, under the circumstance that the heat exchanging performances are the same, if the value of L/D is small, that is the thickness of the heat exchanger is large, the gas-liquid separation of the refrigerant tends to occur inside the first passage 101 since the first passage 101 is long, which may cause a nonuniform distribution of the refrigerant, and result in a poor heat exchanging performance of the heat exchanger. In this embodiment, by arranging the inward-extending pipe 23 having the damping function, the gas-liquid separation of the refrigerant may be effectively decreased, thereby improving the heat exchanging performance of the heat exchanger.

The embodiments described hereinabove are only several embodiments of the present application, and are not intended to limit the scope of the present application in any form. Although the present application is disclosed by the above preferred embodiments, the preferred embodiments should not be interpreted as a limitation to the present application. For the person skilled in the art, many variations, modifications or equivalent replacements may be made to the technical solutions of the present application by using the technical contents disclosed hereinabove, without departing from the scope of the technical solutions of the present application. Therefore, any simple modifications, equivalent replacements and modifications, made to the above embodiments based on the technical essences of the present application without departing from the contents of the technical solutions of the present application, are deemed to fall into the scope of the technical solutions of the present application.

What is claimed is:

1. A heat exchanger, comprising a first pipe, a second pipe, a third pipe, a fourth pipe and a heat exchanger core, wherein the heat exchanger core comprises a plurality of first plates and a plurality of second plates which are alternately stacked together, the first plates and the second plates cooperate with each other to form a plurality of first flow passages and a plurality of second flow passages, the plurality of first flow passages and the plurality of second flow passages are spaced from each other;

each of the first plates comprises a first orifice, a second orifice, a third orifice and a fourth orifice, and each of the second plates comprises a first orifice, a second orifice, a third orifice and a fourth orifice;

the first orifices of the first plates and the first orifices of the second plates are in communication with each other to form a first passage, the second orifices of the first plates and the second orifices of the second plates are in communication with each other to form a second passage, the third orifices of the first plates and the third orifices of the second plates are in communication with each other to form a third passage, the fourth orifices of the first plates and the fourth orifices of the second plates are in communication with each other to form a fourth passage, and the first passage and the second passage are in communication with each other via the plurality of first flow passages or the plurality of second flow passages to form a first fluid passage;

the first passage is in communication with the first pipe, and the second passage is in communication with the second pipe, and the third passage is in communication with the third pipe, and the fourth passage is in communication with the fourth pipe; and at least one damping structure is provided in the first fluid passage, and at least a part of the first fluid passage is in communication with the first pipe or the second pipe via the damping structure, and an equivalent inner diameter of the damping structure is smaller than an equivalent inner diameter of each of the first orifices of the first plates and each of the first orifices of the second plates or an equivalent inner diameter of each of the second orifices of the first plates and each of the second orifices of the second plates, or, a flow area of the damping structure is smaller than a flow area of each of the first orifices of the first plates and the first orifices of the second plates or a flow area of each of the second orifices of the first plates and each of the second orifices of the second plates, wherein the heat exchanger core further comprises a first side plate at an outer side of the heat exchanger core, one side of the first side plate is fixed to the first plate or the second plate, another side of the first side plate is fixedly provided with a mounting plate, the first side plate is provided with a first communicating hole in communication with the first passage, the mounting plate is provided with a first connecting hole in communication with the first communicating hole, the damping structure comprises the first communicating hole, and an equivalent inner diameter of the first communicating hole is smaller than an equivalent inner diameter of the first communicating hole and is also smaller than an inner diameter of each of the first orifices of the first plates and each of the first orifices of the second plates.

2. The heat exchanger according to claim 1, wherein the first pipe is fixed to the mounting plate by welding, one end of the first pipe has at least a part extending into the first connecting hole, and a length of the part extending into the first connecting hole is less than or equal to a length of the first connecting hole, the equivalent inner diameter of the first communicating hole is smaller than an equivalent inner diameter of a main body portion of the first pipe, and the equivalent inner diameter of the first communicating hole ranges from 1.5 mm to 5.5 mm.

3. The heat exchanger according to claim 2, wherein the shape of the first communicating hole is one of circular shape, oval shape, square shape and triangular shape or a combination of at least two of a part of a circular shape, a part of an oval shape, a part of a square shape and a part of a triangular shape, or the first communicating hole comprises a plurality of small holes, and a sum of areas of the plurality of small holes is less than an area of the main body portion of the first pipe.

4. The heat exchanger according to claim 1, wherein in a stacking direction of the first plates and the second plates, the first pipe and the second pipe are respectively arranged at two opposite sides of the heat exchanger, and a length L of a heat exchanging area of the heat exchanger and a thickness D of the heat exchanger satisfy a relationship of $1 \leq L/D \leq 5$.

* * * * *